United States Patent [19]

Okuno et al.

[11] Patent Number: 4,749,292

[45] Date of Patent: Jun. 7, 1988

[54] INK DOT PRINTER

[75] Inventors: Shigeru Okuno; Yoshihiro Torisawa, both of Mishima; Mitsuharu Endo, Susono; Tetsuroh Nakayama, Mishima; Masashi Shimosato, Shizuoka; Takafumi Fukushima, Fuji, all of Japan

[73] Assignee: Tokyo electric Co., Ltd., Tokyo, Japan

[21] Appl. No.: 788,348

[22] Filed: Oct. 17, 1985

[30] Foreign Application Priority Data

| | | | |
|---|---|---|---|
| Oct. 25, 1984 | [JP] | Japan | 59-224384 |
| Nov. 6, 1984 | [JP] | Japan | 59-233945 |
| Nov. 6, 1984 | [JP] | Japan | 59-233947 |

[51] Int. Cl.[4] ..... B41J 3/12; B41J 27/18

[52] U.S. Cl. ..... 400/124; 101/93.05; 346/140 R; 400/119; 400/470

[58] Field of Search ..... 400/121, 124, 174, 470, 400/118, 119; 346/140; 101/93.05

[56] References Cited

U.S. PATENT DOCUMENTS

| | | | |
|---|---|---|---|
| 3,509,816 | 5/1970 | Spaulding | 400/119 X |
| 4,552,469 | 11/1985 | Tsuge et al. | 400/470 X |
| 4,603,338 | 7/1986 | Nakayama et al. | 400/124 X |
| 4,696,589 | 9/1987 | Okuno et al. | 400/124 X |

FOREIGN PATENT DOCUMENTS

| | | | |
|---|---|---|---|
| 54-4129 | 1/1979 | Japan . | |
| 12851 | 4/1980 | Japan | 400/124 |
| 56-95682 | 8/1981 | Japan . | |
| 142371 | 9/1982 | Japan | 400/124 |
| 159662 | 10/1982 | Japan | 400/124 |
| 188449 | 10/1984 | Japan | 400/470 |
| 4070 | 1/1985 | Japan | 400/124 |
| 4073 | 1/1985 | Japan | 400/124 |
| 4074 | 1/1985 | Japan | 400/124 |
| 92862 | 5/1985 | Japan | 400/124 |
| 219064 | 11/1985 | Japan | 400/124 |

*Primary Examiner*—Edgar S. Burr
*Assistant Examiner*—James R. McDaniel
*Attorney, Agent, or Firm*—Frishauf, Holtz, Goodman & Woodward

[57] ABSTRACT

An ink dot printer comprises a recording sheet, at least one needle made of an electrically conductive material and located in one side of the recording sheet so as to move between a normal position remote from the recording sheet and a projected position close to the recording sheet, a drive mechanism for displacing the needle between the normal position and the projected position, an ink supply mechanism for supplying and attaching ink to the tip of the needle which faces the recording paper when the needle is in the normal position, an electrode disposed on another side of the recording mechanism and facing the tip of the needle, and an electric field generating mechanism for generating, between the electrode and needle, an electric field of such intensity as to cause ink to fly from the tip of the needle, when the needle is closer to the recording sheet than the normal position, toward the recording sheet to thereby form an ink dot on the recording sheet.

4 Claims, 5 Drawing Sheets

INK DOT PRINTER

BACKGROUND OF THE INVENTION

This invention relates to an ink dot printer which comprises at least one needle capable of being displaced between a normal position remote from a recorded medium and a projected position close to the recorded medium, and drive means for moving the needle between the normal position and projected position and in which ink is supplied to and attached on the tip of the needle which faces the recording means when the needle is at the normal position. The ink is forcibly removed from the tip of the needle toward the recorded medium to form an ink dot on the recorded medium when the needle is at the projected position, an aggregate of such ink dots serving to form a character or a figure on the recorded medium.

The usual ink dot printer of the type described above is provided with ink film forming means serving as ink supply means. The ink film forming means comprises a pair of magnetic plates extending parallel to each other and forming a vertical slit therebetween, an ink tank containing magnetic ink in which the lower ends of the paired magnetic plates are immersed, and exciting means for exciting the pair of magnetic plates to let the magnetic ink be withdrawn from the ink tank along the slit so as to form a magnetic ink film in the slit.

In this arrangement, the tip of the needle is placed in the slit when the needle is in the normal position, and magnetic ink from the magnetic ink film in the slit is attached to the tip of the needle.

In an ink dot printer of this type, the needle is moved from the normal position to the projected position to cause the tip of the needle to strike a recording sheet serving as a recorded medium and lying on a platen, thereby forming an ink dot on the recording sheet. The striking of the recording sheet by the needle, however, produces a tremendous amount of noise.

SUMMARY OF THE INVENTION

This invention has been developed in light of the above, and its object is to provide an ink dot printer which can reliably and clearly form an ink dot on a recorded medium without generating any amount of noise.

To attain the above object of the invention, there is provided an ink dot printer which comprises: a recorded medium; at least one needle made of an electrically conductive material and located at one side of the recorded medium so as to move between a normal position remote from the recorded medium and a projected position close to the recorded medium; drive means for displacing the at least one needle between the normal position and projected position; ink supply means for supplying and attaching ink to the tip of the needle which faces the recorded medium, when the needle is in the normal position; an electrode disposed on the other side of the recorded medium and facing the tip of the at least one needle; and electric field generating means for generating, between the electrode and needle, an electric field of such intensity as to cause ink to fly from the tip of the needle, when the needle is closer to the recorded medium than in said normal position, toward the recorded medium to thereby form an ink dot on the recorded medium.

With this construction, even if the needle is spaced sufficiently far apart from the recorded medium so as not to produce noise when the needle is displaced in the projected position, a strong electric field produced between the needle and the electrode by application of a voltage therebetween, will, with reliability, cause ink attached at the tip of the needle to fly toward the electrode (i.e., toward the recorded medium) to form a clear ink dot on the recorded medium.

In the ink dot printer of this invention and which has the above construction, where the ink supply means includes ink film forming means for forming an ink film in which the tip of the needle is immersed to let ink be attached to the tip of the needle when the needle locates at the normal position, it is preferable that the needle is disposed at the normal position such that the tip end surface of the tip is in contact with the inner surface of the ink film which locates on the side of the recorded medium or slightly projects from the inner surface of the ink film so as to receive ink from the ink film by means of the surface tension in the inner surface.

The amount of ink utilized for the formation of an ink dot on the recorded medium varies with the position of the tip of the needle in the ink film. If the tip of the needle which locates at the normal position breaks the inner surface of the ink film which locates on the side of the recorded medium and projects toward the recorded medium, the amount of ink attached to the tip of the needle will, desirably, be insufficient to result in the blurring of an ink dot formed on the recorded medium. On the other hand, if the distance between the tip of the needle which locates at the normal position and the inner surface of the ink film is increased in the direction away from the recorded medium, the amount of ink attached to the tip of the needle is increased. Consequently, an ink drop caused to fly from the needle at the projected position will be spattered as it contacts the recorded medium. In this latter case, it is difficult to form a satisfactory ink dot on the recorded medium.

Further, if the distance between the tip of the needle which locates at the normal position and the inner surface of the ink film is increased in the direction away from the recorded medium, it is likely that a wave will be formed on the outer surface of the ink film which locates on the side of the recorded medium by the displacement of the needle between the normal position and projected position. For this reason, where there are a plurality of needles and two adjacent needles are displaced simultaneously toward the projected position, it is likely that ink will be splashed between the needles and spattered on the recorded medium. Further, when a wave is formed on the outer surface of the ink film, the amount of ink attached to the tip of the needle is varied, so that it is impossible to form ink dots of a uniform size and uniform density on the recorded medium.

By so setting the normal position of the needle the tip of the needle is in contact with the inner surface of the ink film which locates on the side of the recorded medium or slightly projects from the inner surface of the ink film, the amount of ink attached to the tip of the needle can be standardized, making it possible to eliminate the splashing of ink caused between two adjacent needles by their displacement.

In the ink dot printer according to the invention, where the ink supply means includes ink film forming means for forming an ink film in which the tip of the needle is immersed to let ink be attached to the tip of the needle when the needle locates at the normal position, and the ink film forming means includes a pair of magnetic plates extending parallel to each other and forming a vertical slit therebetween, an ink tank containing magnetic ink in which the lower ends of the pair of magnetic plates are immersed, and exciting means for exciting the pair of magnetic plates to let the magnetic ink be withdrawn from the ink tank along the slit so as to form a magnetic ink film in the slit, it is preferable that the needle is made of a non-magnetic material having electrical conductivity. When the needle is made of a magnetic material, it is magnetized by the magnetic field in the slit between the pair of magnetic plates, so that magnetic ink is held magnetically by the magnetized needle. In such a case, it is difficult to cause magnetic ink to fly from the tip of the magnetized needle at the projected position toward the recorded medium. Besides, it is difficult to discharge magnetic ink from the slit between the pair of magnetic plates when the printer has been out of use for a long time.

DETAILED DESCRIPTION OF THE PREFERRED EMBODIMENTS

Figure 1:
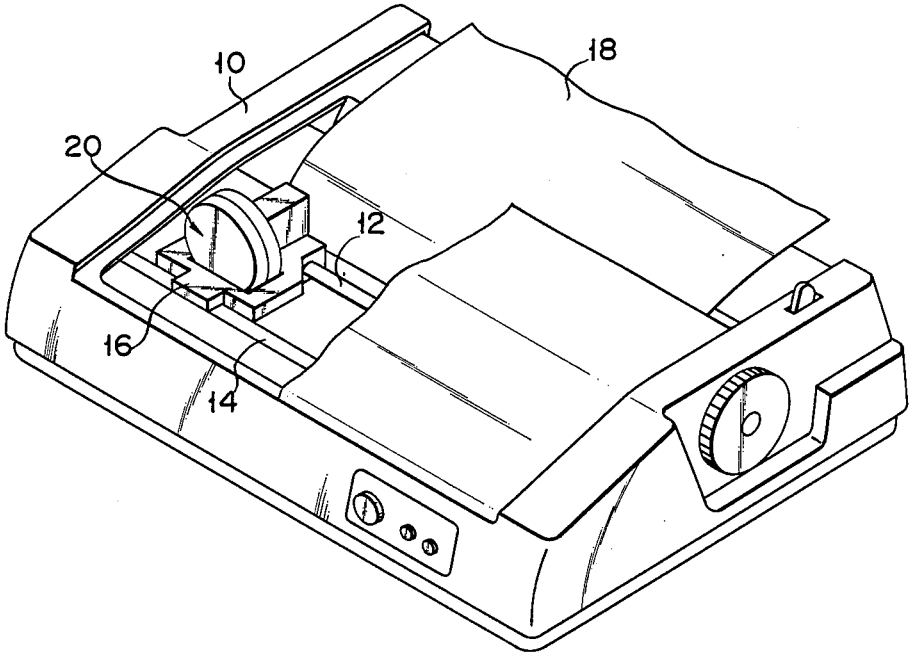
FIG. 1 is a perspective view, partly broken away, showing an embodiment of the ink dot printer according to the invention.

FIG. 1 shows an embodiment of the ink dot printer according to the invention. The illustrated ink dot printer has a housing 10 which accommodates a carriage shaft 12 and a guide shaft 14 that extend parallel to each other. A carriage 16 is mounted for reciprocal movement on the carriage shaft 12 and guide shaft 14. A printing head 20 facing a recording sheet 18 which serves as a recorded medium is mounted on the carriage 16.

Figure 2:
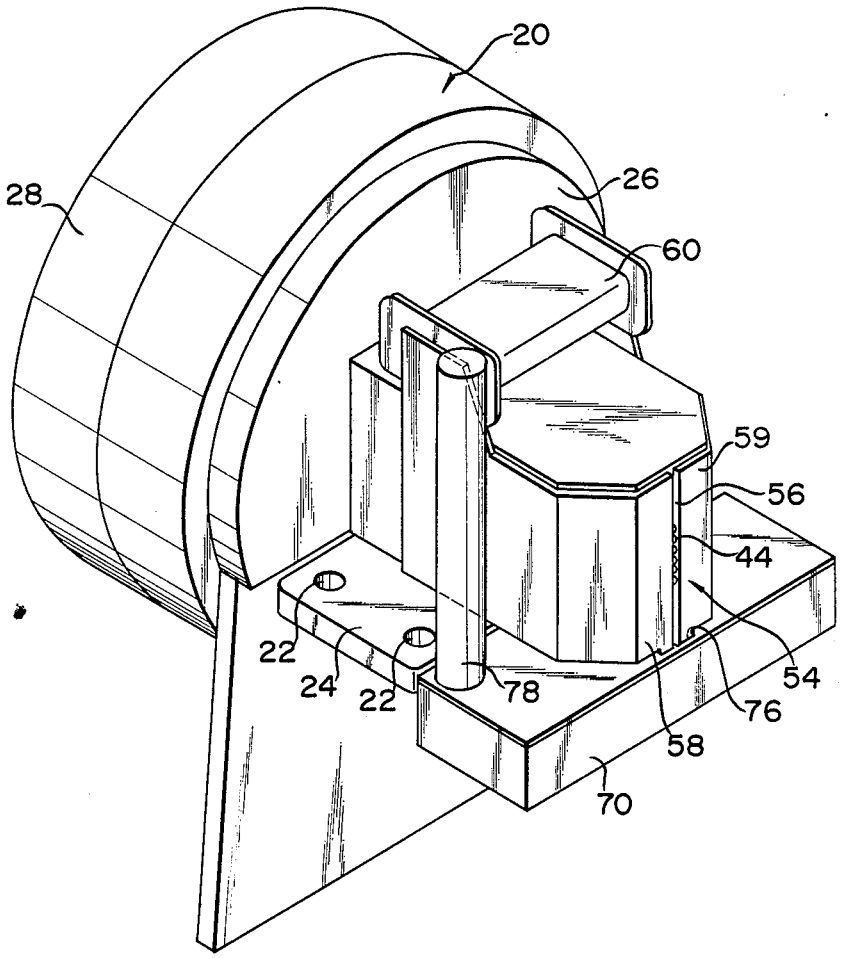
FIG. 2 is a perspective view, enlarged in scale, showing the printing head in the ink dot printer shown in FIG. 1.

As clearly shown in FIG. 2, the printing head 20 has a head support 24 having bolt holes 22 or receiving bolts (not shown) for bolting the printing head 20 to the carriage 16. A head cover 26, made of a synthetic resin, is mounted on the head support 24. A rear circular portion 28 of the head cover 26 accommodates needle drive means 30, as shown in FIG. 3.

Figure 3:
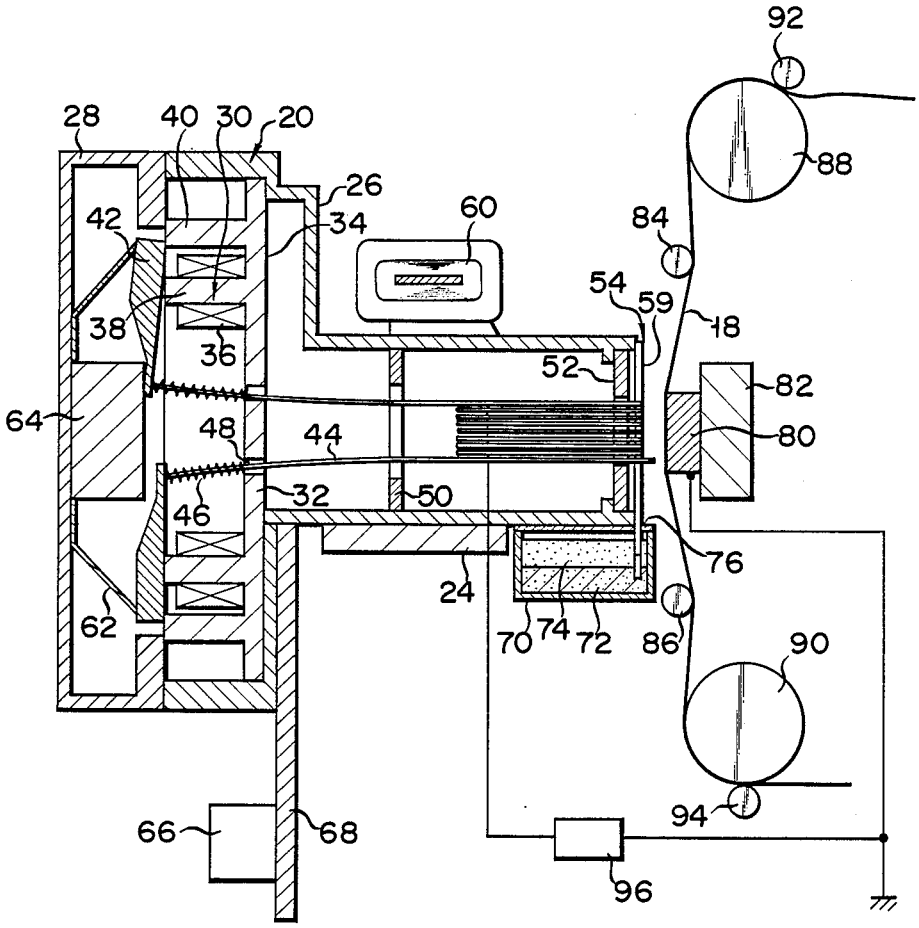
FIG. 3 is a longitudinal sectional view schematically showing the printing head, recorded medium facing the printing head and peripheral components of the recorded medium shown in FIG. 1.
Figure 4:
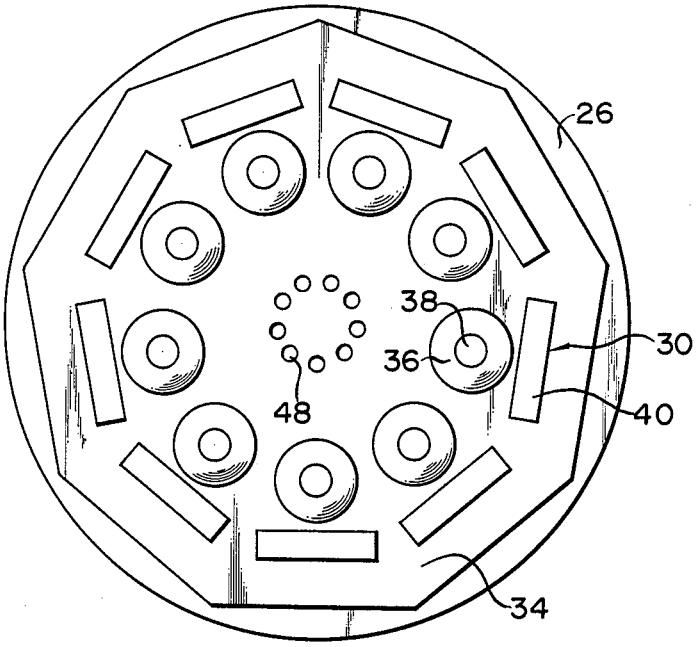
FIG. 4 is a rear view showing a magnetic member with cores and coils, constituting an electromagnet of needle drive means for the printing head shown in FIG. 3.

The needle drive means 30 has a magnetic member 34 which is made of a magnetic material and is bonded to a stepped portion of the head cover 26, as shown in FIG. 3. The magnetic member 34 has a partition wall 32 of a flat shape. The partition wall 32, as shown in FIGS. 3 and 4, has a plurality of cores 38 which are in a circular arrangement and each of which carries a coil 36 wound thereon. The magnetic member 34 further has yokes 40 located outside of the cores 38 in the radial direction. The coils 36 are energized by a printing signal provided from control means (not shown). In this embodiment, the voltage applied to the coils 36 is from about 12 to about 13 volts.

The base portion of an armature 42 is rotatably mounted on the each yoke 40 so as to make the armature 42 face the corresponding core 38, as shown in FIG. 3. The base end of a needle 44 is fixed to the free end portion of the each armature 42 through insulation means for preventing a failure of electrical insulation between the needle 44 and the armature 42. In ,this embodiment, the fixed point of the free end portion to which the base end of the needle 44 is fixed is made of electrically insulation material and tbe number of needles 44 is nine. Each needle 44 is made of a non-magnetic material having electrical conductivity, e.g., stainless steel. The diameter of the needle 44 is approximately 0.2 mm. As shown in FIG. 3, a needle spring 46 is wound around the needle 44 between the partition wall 32 of the magnetic member 34 and the armature 42. The needle spring 46 urges the armature 42, together with the needle 44, rearward of the head cover 26 (i.e., to the left in FIG. 3). The nine needles 44 penetrate through holes 48 formed in a circular arrangement in the partition wall 32 of the magnetic member 34, as shown in FIG. 4. These needles 44 further penetrate an intermediate guide 50 and an free end guide 52 provided in the head cover 26 and the free ends of these needles 44 reach ink film forming means 54 which serves as ink supply means, as shown in FIG. 3.

The ink film forming means 54 includes a pair of vertically disposed magnetic plates 58 and 59 extending parallel to each other to form a vertical slit 26 (see FIG. 2) between them. The ink film forming means 54 further includes an electro magnet 60 serving as exciting means. The electro magnet 60 is disposed on top of the head cover 26 and is coupled to the rear ends of the pair of magnetic plates 58 and 59 which extend rearward along the both side surfaces of the head cover 26. The circular portion 28 of the head cover 26, as shown in FIG. 3, further accommodates a return spring 62 urging the armature 42 in the returning direction, and a stop 64 which determines the return position of the armature 42. A printed wiring board 68 is fixed to the head cover 26. The printed wiring board 68 has an electric circuit for controlling the energization of the coil 36, and is provided with a connector 66.

The ink film forming means 54 further includes an ink tank 70 made of a synthetic resin. The ink tank 70 is fixed to the underside of a front end portion of the head cover 26. An ink impregnation member 72 is mounted in the ink tank 70 and magnetic ink 74 is stored in the ink tank 70. A hole 76 is formed at the top of the ink tank 70. Lower end portions of the pair of magnetic plates 58 and 59 are inserted into the hole 76 and immersed in the magnetic ink 74. An ink cartridge 78 for supplying magnetic ink 74 to the ink tank 70 is removably attached on top of the ink tank 70, as shown in FIG. 2.

The housing 10 of the ink dot printer further accomodates an electrode 80 which also functions as a platen, as shown in FIG. 3. The electrode 80 is supported by an electrode holder 82 so as to make the electrode 80 face the printing head 20. In this embodiment, the electrode 80 is made of copper and the surface of the electrode 80 which is to be contacted the recording sheet 18 is provided with an insulating film of a polyimide resin. The opposite side ends of the electrode 80 are supported by side plates (not shown) in the housing 10 through electric insulating members (not shown).

Sheet pressing guide rollers 84 and 86 for bringing the recording sheet 18 into closely contact with the electrode 80 are provided above and below the electrode 80. A sheet feed roller 88 and a sheet tension roller 90 are provided above and below the sheet pressing guide rollers 84 and 86, respectively. The sheet feed roller 88 is paired with a sheet feed pressing roller 92. The sheet tension roller 90 is paired with a sheet pressing roller 94.

Figure 5:
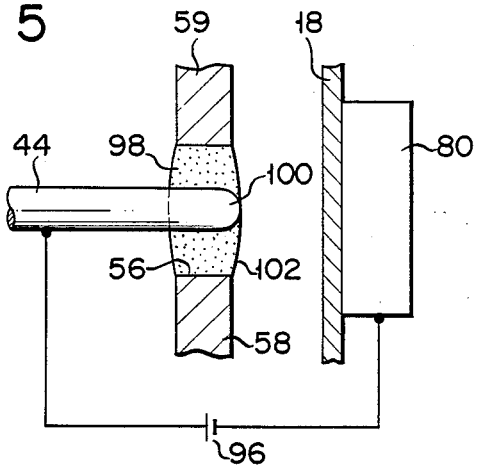
FIG. 5 is a sectional view taken in a horizontal direction, schematically showing a needle which locates at the normal position, with the tip thereof immersed in a magnetic ink film formed in a slit between the pair of the magnetic plates of the ink film forming means, the tip of the needle noted above being in contact with the inner surface of the magnetic ink film which locates on the side of the recorded medium.

A voltage of a predetermined strength is applied between the needles 44 and the electrode 80 from power source means 96 to produce an electric field of a predetermined field intensity. Further, in this embodiment the free end surface of the free end of each needle 44 is rounded, as shown in FIG. 5, to prevent discharge between it and the electrode 80.

With the embodiment of the ink dot printer having the above construction, when the electro magnet 60 of the ink film forming means 54 is energized, a magnetic field is produced in the slit 56 between the pair of magnetic plates 58 and 59. As a result, the magnetic ink 74 in the ink tank 70 is withdrawn upwards along the slit 56 to form a magnetic ink film 98 having a predetermined thickness, as shown in FIG. 5. At this time, the free end surface of the free end 100 of each needle 44 located in the normal position is in contact with the inner surface 102 of the magnetic ink film 98 which locates on the side of the recording sheet 18. Further, simultaneous with the energization of the magnet 60 in the ink film forming means 54, an electric field of a predetermined intensitY is formed between each needle 44 and the electrode 80 by the power source means 96. However, the intensity of this electric field is insufficient to cause the magnetic ink to fly from the free end surfaces of the free ends 100 of the needles 44 toward the electrode 80 (i.e., toward the recording sheet 18) when the needles 44 are located in the normal position.

Figure 6:
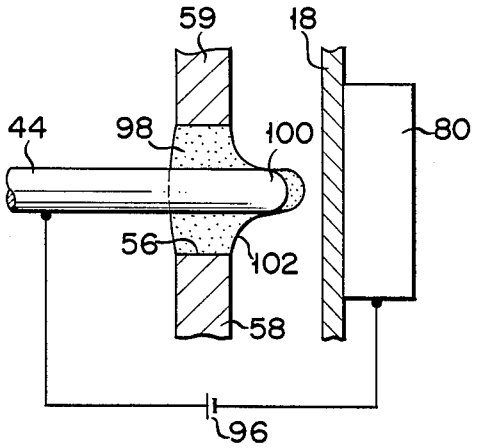
FIG. 6 is a sectional view similar to FIG. 5, schematically showing the needle which locates at a projected position, with the tip of the needle projecting from the inner surface of the magnetic film and being closer to the recorded medium.

However, when the needle 44 is displaced to a projected position nearer the recording sheet 18, as shown in FIG. 6, a predetermined amount of magnetic ink attached to the free end surface of the free end 100 of the needle 44 is caused, by the electric field, to fly toward the electrode 80 (i.e., toward the recording sheet 18), because the strength of the electric field between the needle 44 and the electrode 80 is increased. In consequence, an ink dot having a predetermined size is formed on the recording sheet 18.

In this embodiment, the free end surface of the free end 100 of the needle 44 located in the normal, i.e., non-projected, position (see FIG. 5) is in contact with the inner surface 102 of the magnetic ink film 98 which locates on the side of the recording sheet 18. Therefore, even when the needle 44 is moved between the normal position shown in FIG. 5 and the projected position shown in FIG. 6, no great wave is produced on the surface 102 of the magnetic ink film 98. Thus, a standard amount of magnetic ink in the magnetic ink film 98 is attached to the free end surface of the free end 100 of the needle 44 when the needle 44 locates at the normal position. Moreover, even when two adjacent needles 44 are simultaneously displaced from the normal position to the projected position, no magnetic ink will be caused to splash out from between the adjacent two needles 44 toward the recording sheet 18. It is thus possible to form ink dots having a constant size and density on the recording sheet 18.

It is well known from several documents that the magnetic ink having low resistivity and good electric conductivity have difficulty in flying by a electric field. In this invention, since the needle 44 is made of an electrically conductive material, magnetic ink which is easily propelled by a electric field (that is, have high resistivity and low electric conductivity) can be used in the ink dot printer of this invention.

The above embodiment of the invention is given for the purpose of illustrating the invention and is by no means limitative. Various changes and modifications of the above embodiment thus ma be made without departing from the scope of the invention.

Figure 7:
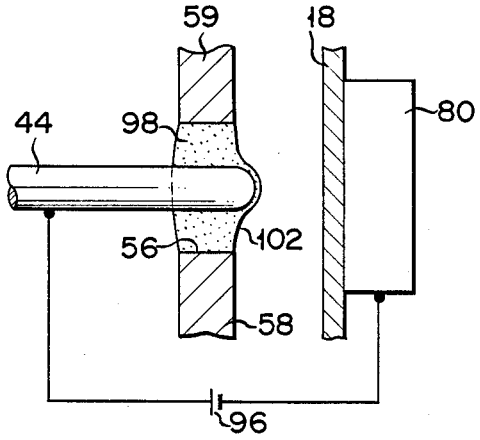
FIG. 7 is a sectional view similar to FIGS. 5 and 6, but showing a needle in a modification of the ink dot printer, the needle being located at a normal position with the tip thereof slightly projecting from the inner surface of the magnetic ink film, magnetic ink being supplied to the tip surface of the tip of the needle from the magnetic ink film by the surface tension of the magnetic ink.

For example, the free end surface of the free end 100 of the needle 44 may slightly project from the inner surface 102 of the magnetic ink film 98 when the needle 44 locates at the normal position, as shown in FIG. 7. With this arrangement, the same effects as with the above embodiment may be obtained, so long as magnetic ink is supplied to the free end surface of the free end 100 of the needle 44 by the surface tension in the surface 102 of the magnetic ink film 98.

Power source means 96 may be so constructed that, as electric insulating means between the armature 42 and the needle 44, voltage in the needle 44 becomes zero and voltage in the electrode 82 becomes plus or minus.

And, as non-magnetic material having electric conductivity for the needle 44, metal, such as tungsten, borontungsten or brass. etc., and reinforced plastic, such as CFRP (carbon fiber reinforced plastic), including electric conductive material may be used.

What is claimed is:

1. An ink dot printer comprising:

a recorded medium;

at least one needle made of an electrically conductive non-magnetic material and located in one side of the recorded medium so as to move between a normal position remote from said recorded medium and a projected position close to said recorded medium;

drive means for displacing said at least one needle between said normal position and said projected position;

ink supply means for supplying and attaching ink to the tip of said needle which faces said recorded medium, when said needle is in the normal position;

an electrode disposed on another side of said recorded medium and facing the tip of said at least one needle; and electric field generating means for generating, between said electrode and needle, an electric field of such intensity as to cause ink to fly from the tip of said needle, when the needle is closer to said recorded medium than said normal position, toward said recorded medium to thereby form an ink dot on said recorded medium.

2. The ink dot printer according to claim 1, wherein said ink supply means includes ink film forming means for forming an ink film in which the tip of said needle is immersed to let ink be attached to the tip of said needle when said needle locates at said normal position, the needle being disposed at the normal position such that its tip surface of the tip is in contact with the inner surface of the ink film which locates on the side of the recording means or slightly projects from the inner surface of the ink film so as to receive ink from the ink film by means of the surface tension in said inner surface.

3. The ink-dot printer according to claim 2, wherein said ink supply means includes ink hlding means for holding magnetic ink, and said ink film forming means includes a pair of magnetic plates arranged to make a slit therebetween into which the tip end of said needle located at the normal position is located, and magnetic force generating means connected to said magnetic plates so as to magnetize said magnetic plates, the tip end of said needle located at the normal position being immersed in said ink film, whereby magnetic ink in said ink holding means is attracted and held in said slit so as to make said ink film.

4. The ink -dot printer according to claim 3, wherein said magnetic force generating means is an electro magnet.

* * * * *